US007337760B2

(12) United States Patent
Digregorio

(10) Patent No.: US 7,337,760 B2
(45) Date of Patent: Mar. 4, 2008

(54) ENGINE ROOM IN A SEALABLE CONTAINER

(75) Inventor: Robert Digregorio, Cutchogue, NY (US)

(73) Assignee: Stidd Systems, Inc., Greenport, NY (US)

( * ) Notice: Subject to any disclaimer, the term of this patent is extended or adjusted under 35 U.S.C. 154(b) by 82 days.

(21) Appl. No.: 10/960,523

(22) Filed: Oct. 7, 2004

(65) Prior Publication Data

US 2006/0075987 A1 Apr. 13, 2006

(51) Int. Cl.
*F02B 77/00* (2006.01)

(52) U.S. Cl. ..... 123/198 E

(58) Field of Classification Search ..... 123/198 E, 123/195 P, 184.21; 440/88 F, 88 A, 88 C, 440/88 L, 88 R, 84; 114/253
See application file for complete search history.

(56) References Cited

U.S. PATENT DOCUMENTS 1,694,790 A * 12/1928 Nelson ..... 440/111
3,648,643 A * 3/1972 Murray ..... 114/382
3,812,813 A * 5/1974 Dickson ..... 440/71
3,850,130 A * 11/1974 Heuschober ..... 440/84
4,734,070 A * 3/1988 Mondek ..... 440/88 R
4,971,586 A * 11/1990 Walsh ..... 440/88 R
5,282,764 A 2/1994 Glen
5,573,436 A 11/1996 Trudeau et al.
5,577,456 A 11/1996 Kobayashi et al.
5,632,659 A 5/1997 Martin et al.
5,990,809 A * 11/1999 Howard ..... 340/988
2003/0143902 A1 7/2003 McChesney et al.

* cited by examiner

*Primary Examiner*—Stephen K. Cronin
*Assistant Examiner*—Hyder Ali
(74) *Attorney, Agent, or Firm*—Schweitzer Cornman Gross & Bondell LLP

(57) ABSTRACT

A sealable engine containment assembly provides a waterproof environment for an internal combustion engine and ancillary equipment, thus performing a "engine room" in a sealable container. The container includes an air inlet port for passage of air from the container exterior, and an exit port for passage of engine exhaust to the container's exterior. Both the inlet and exhaust ports have valves to isolate the port from the container exterior when the engine is not operating. A waterproof coupling for transmission of engine drive shaft output may be provided, along with waterproof couplings for electrical, hydraulic and fuel lines. The engine assembly is of utility in open-hull submersible vessels as well as for use in other environments where potential water ingress could prove deleterious to conventional internal engine assemblies.

12 Claims, 5 Drawing Sheets

ENGINE ROOM IN A SEALABLE CONTAINER

The present invention relates to an internal combustion engine assembly in the form of a sealable container enclosing the engine and such ancillary subsystems necessary for operation of the engine as may be commonly found in the engine room of a watercraft, for use in open hull submersible vehicles and other applications.

BACKGROUND OF THE INVENTION

It is well known that conventional internal combustion engines, while rugged and capable of operation in a variety of ambient conditions, are unlikely to remain operational after submersion in water.

In large submersible vessels, such as military diesel submarines, the entirety of the vessel interior, including an engine compartment is enclosed in the submarine's pressure container, allowing personnel access to the engine at all times and providing protection for the engine from the surrounding seas. Fuel lines, electrical circuits, and ancillary equipment are located within the sealed vessel interior. Valved ducts from the engine room and engine pass through the hull for air and water inlet and exhaust during surface operations.

In open hull, or "wet", submersible vessels, however, the vessel's crew and occupants are not within a closed, watertight area. Rather, personnel are exposed to the water when the vessel is submerged, and normally wear SCUBA gear to provide breathing air. Thus, an internal combustion engine utilized for surface propulsion must be provided with individual protection from the surrounding water upon submergence. While It may theoretically be possible to design an engine that can be directly exposed to water, and particularly the corrosive effects of sea water, the requirements and constraints associated with the large horsepower engine needed for a multi-occupant vessel with their associated gear make such a design costly and inefficient.

Thus, enclosing an engine of generally conventional construction is a more viable solution. Such a solution, however, must address numerous issues and design constraints. Provision must be made for access to the engine for maintenance and repair, if necessary, when the vessel is on surface. In addition, the procedures by which the engine is prepared for submerging, and made ready for restart upon surfacing, must be capable of being performed rapidly and with a minimum of steps to allow for prompt changeover between surface and submerged travel conditions.

In addition to marine uses, other potential applications for internal combustion engines are restricted as a result of the sensitivity of such engines to water. Emergency electric generation facilities, and off-road land vehicles are two such applications.

It is accordingly a purpose of the present invention to provide a sealable internal combustion engine container assembly for use in a variety of applications, including but not limited to submersible vehicles such as open-hull submersible vehicles, as motive power for an emergency electric generation facility, and the like.

A further purpose of the present invention is to provide such a sealable engine container assembly which is of compact and efficient construction, and which provides a waterproof environment for an internal combustion engine.

Yet another purpose of the present invention is to provide a sealable engine container assembly that can be easily and efficiently installed in, and removed from, a desired installation.

Still a further purpose of the present invention is to provide such a sealable engine container assembly which allows for prompt and efficient sealing of the assembly to fully isolate the enclosed engine from the surrounding environment when shut down and which allows prompt re-introduction of the surrounding environment for starting and operation of the engine.

BRIEF DESCRIPTION OF THE INVENTION

In accordance with the foregoing and other objects and purposes, a sealable internal combustion engine assembly in accordance with the present invention comprises a waterproof shell or housing and an internal combustion engine within the housing. The housing may have a sealed coupling for transmission of the engine's drive shaft output, allowing the engine's motive output to be joined to apparatus, such as a propulsion system, located exterior to the housing. The housing has an air inlet port with a watertight cover to allow ambient air to enter the interior of the housing and be drawn into the engine as needed through inlet ports as needed for combustion purposes during engine operation, and a valved cooling water port coupled to the cooling jacket of the engine. A valved exhaust port extends through the housing to vent exhaust gasses to the housing exterior, and may further serve to vent other fluids, such as coolant, to the housing exterior. Each of the valves is preferably located exterior to the housing. Waterproof passages for electrical lines between the interior and exterior of the housing for control signals and functions may be provided. Valved fuel lines also pass through the housing wall, providing a fuel delivery system for the engine from a remote fuel reservoir. In a preferred embodiment, the fuel reservoir may be in the form of one or more fuel bladders that may be collapsible as fuel is drawn therefrom. Access ports in the housing allow maintenance and inspection of the engine to be performed without removing the engine from the housing.

BRIEF DESCRIPTION OF THE DRAWINGS

A fuller understanding of the present invention can be obtained upon consideration of the following detailed description of a preferred, but nonetheless illustrative embodiment of the invention, when reviewed in conjunction with the annexed drawings, wherein.

DETAILED DESCRIPTION OF THE INVENTION

Figure 1:
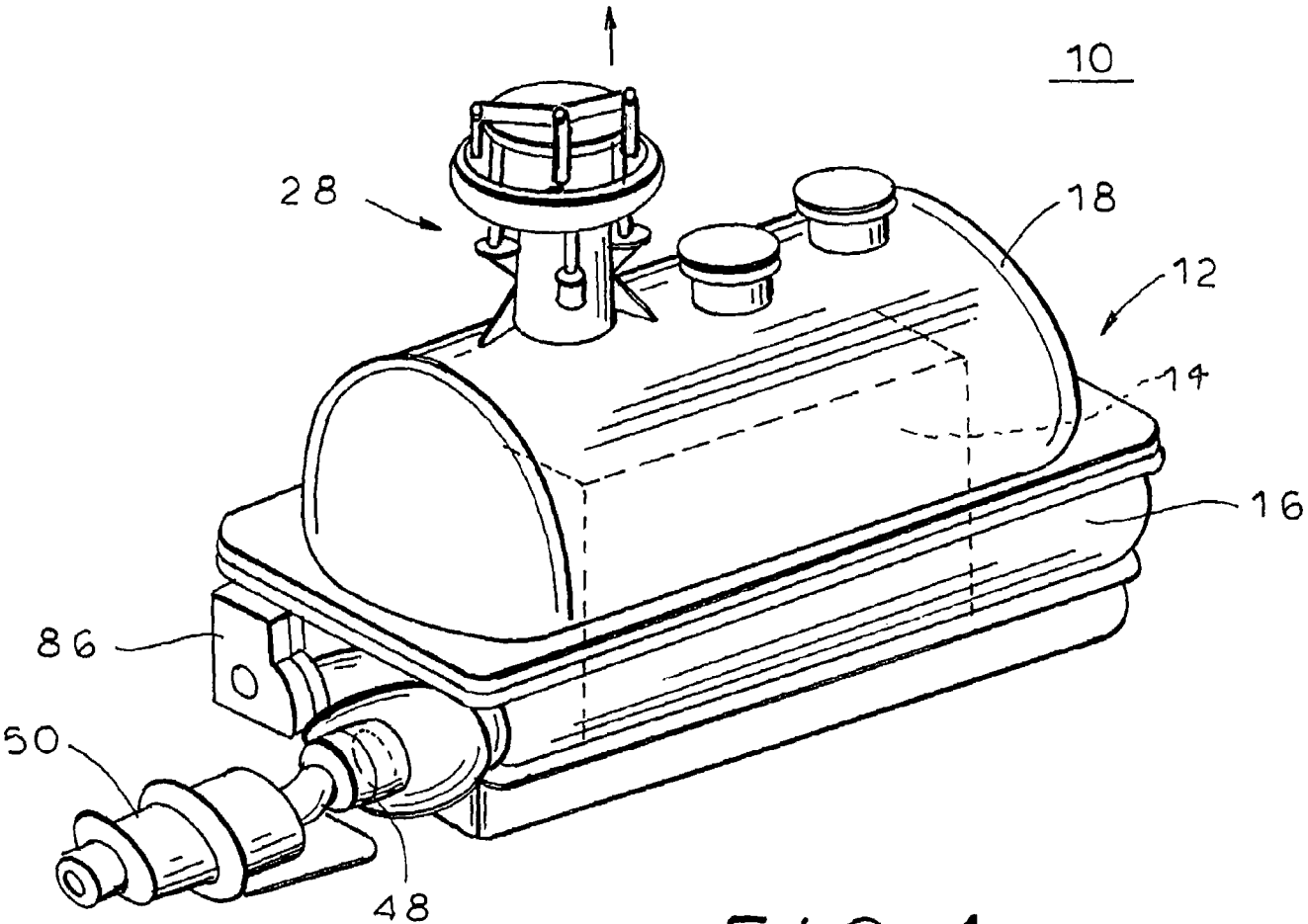
FIG. 1 is a perspective view of a sealable engine room assembly of the invention, depicting in phantom an engine within the sealed housing, the engine being coupled to-a water jet propulsion system in a submersible marine vessel.
Figure 2:
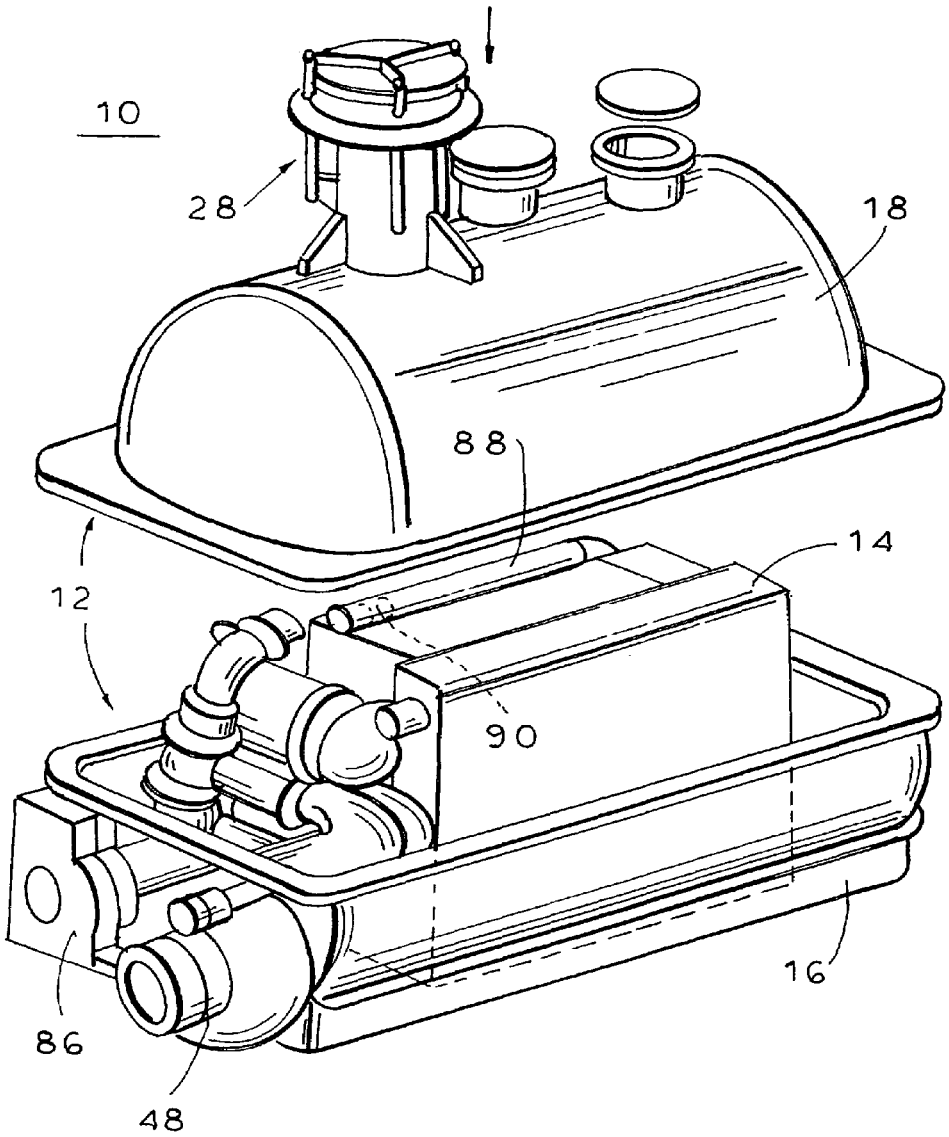
FIG. 2 is a perspective view of the invention depicting the upper portion of the housing removed from the lower portion, exposing the engine located inside the housing.

With initial reference to FIG. 1, inventive engine room system 10 comprises a container 12 forming a sealable watertight shell or housing, preferably formed of an appropriate aluminum alloy of appropriate strength, corrosion resistance and light weight, in which is located internal combustion engine 14. For marine use the container should also be capable of withstanding the external pressure of the expected operational depth of the vessel. For marine use the engine may preferably be a marine diesel engine, such as a Yanmar 6LY2-STE, a 6-cylinder engine capable of developing 420 hp, sufficient for a multi-occupant, wet submersible vessel. Other types of engines may be used in accordance with the intended purpose of the system. Waterproof pass-throughs are provided for the engine drive shaft, exhaust, fuel supply, electrical connections, cooling water, hydraulic lines, and engine controls. The container has a base portion 16 and a cover portion 18, which is removable for engine installation, access and removal. In a marine vessel environment the base 16 may be mounted to the vessel's hull bottom. The base and cover are each provided with peripheral joining flanges with an o-ring seal. The flanges are bolted together to seal the container.

Figure 4:
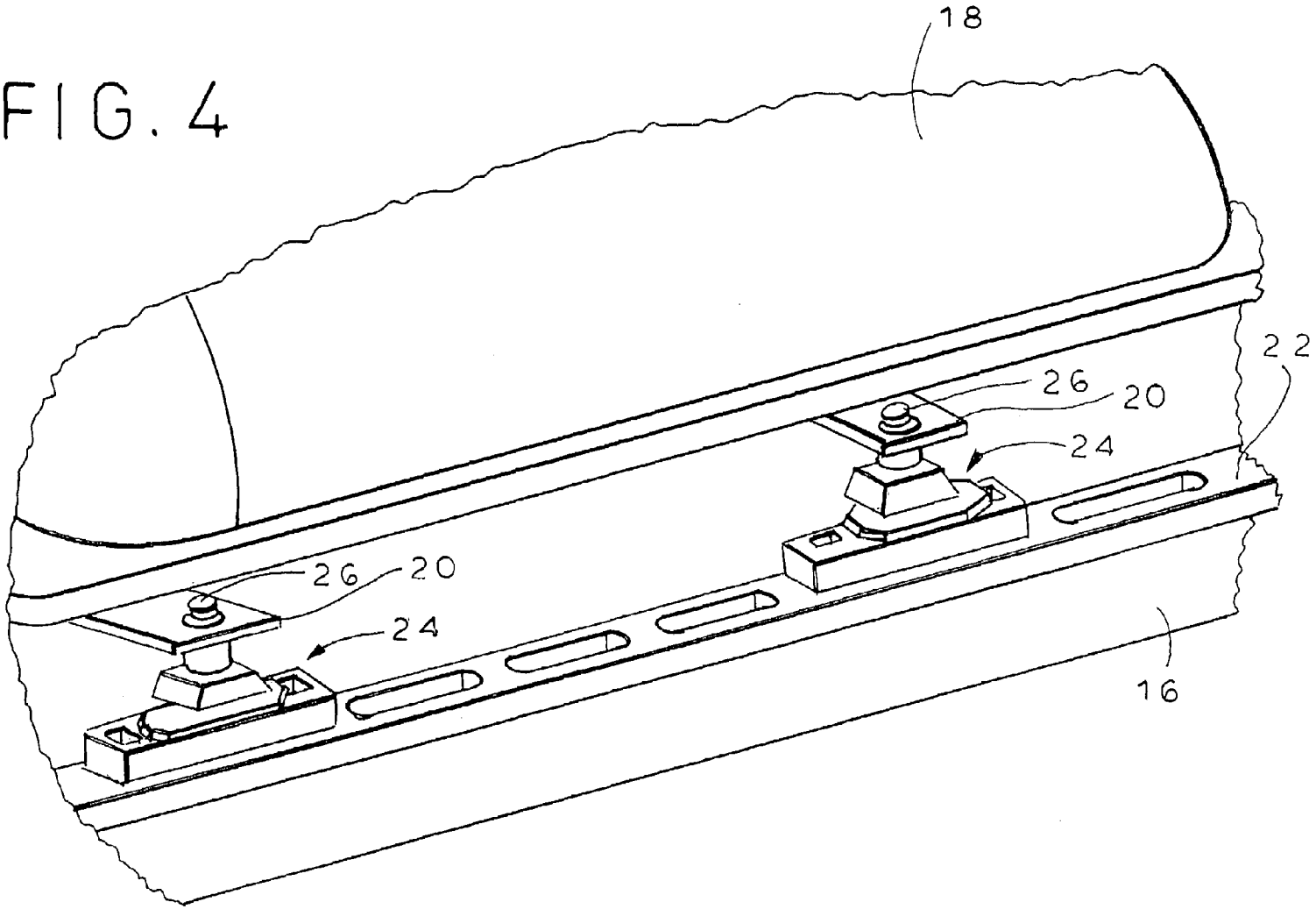
FIG. 4 is a detail perspective view depicting the mounting of the housing to the vessel hull.

As depicted in FIG. 4, the container base 16 may be provided with fore and aft mounting flanges 20. A pair of hull longitudinal beams 22 support resilient motor mounts 24. Vertically-extending shafts 26 of the motor mounts extend through corresponding bores in the flanges 20. Corresponding mounts for the container can be employed in other applications.

Figure 3:
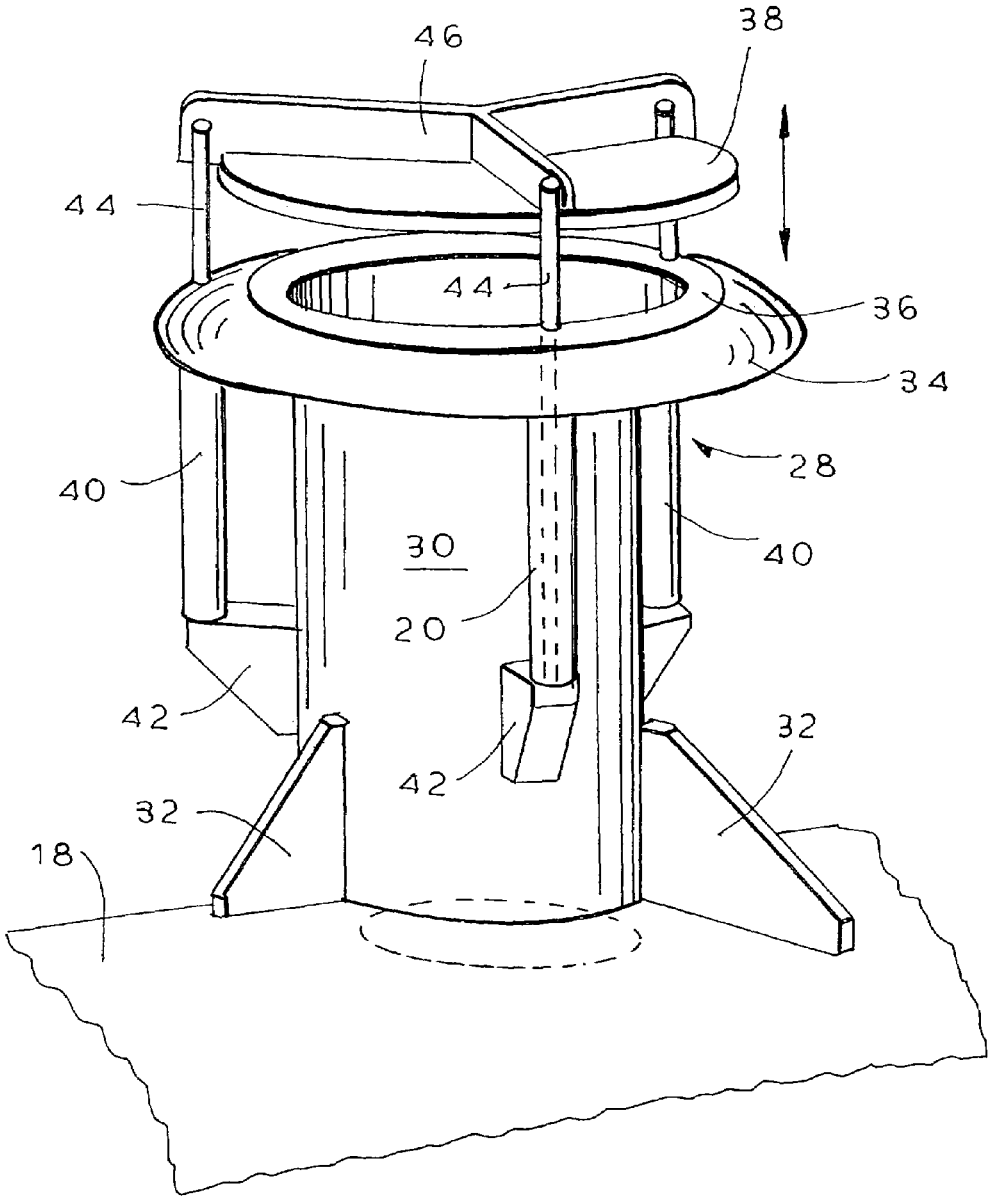
FIG. 3 is a detail perspective view of the housing's air inlet port.

Air intake for the engine is through upwardly extending intake stack assembly 28, as depicted in FIG. 3. Rather than directing air directly into the engine, the intake stack assembly directs air into the container interior, from which it is drawn into the engine as required by engine operation. Circulation of the air within the container provides for a measure of cooling for the within the container for electrical and other components. An electric fan 88 may be provided in duct 90 to direct air to the engine's alternator (not shown), the inlet end of the duct being positioned proximate the inlet stack. The construction of the air intake allows air to be drawn even if the main container is submerged.

The air inlet stack assembly 28 comprises vertical conduit 30 supported upon the shell by fillets 32. The upper end of the conduit 30 has a generally bell-shaped mouth 34, with circumferential flat 36. The conduit is sized to allow a sufficient airflow for proper combustion. In the case of the specified Yanmar engine the conduit supports a flow of approximately 1,200 $ft^3$/min., which is about 50% greater than the volume of combustion air needed by the engine. Cover 38 moves vertically to open and close the air inlet stack assembly, and is driven by three ganged hydraulic cylinders 40, each mounted on a bracket 42, the actuator rods 44 passing through bores in mouth 34 and being affixed to Y-shaped cover bracket 46.

Engine output, through the engine's drive shaft, is made available through fitting 48. In the embodiment shown, it is intended that the vessel's surface drive-be in the form of a water jet propulsion drive 50. Accordingly, the engine's output shaft is coupled through the fitting 48 to the input shaft of the water jet system. Seals as known in the art are provided to maintain a waterproof junction. A gear train assembly (not shown) is located within the container housing to match the engine's output speed range to the preferred input speed range for the jet drive 50. Alternative fittings and couplings may be employed to join the output shaft to other devices or systems.

Figure 5:
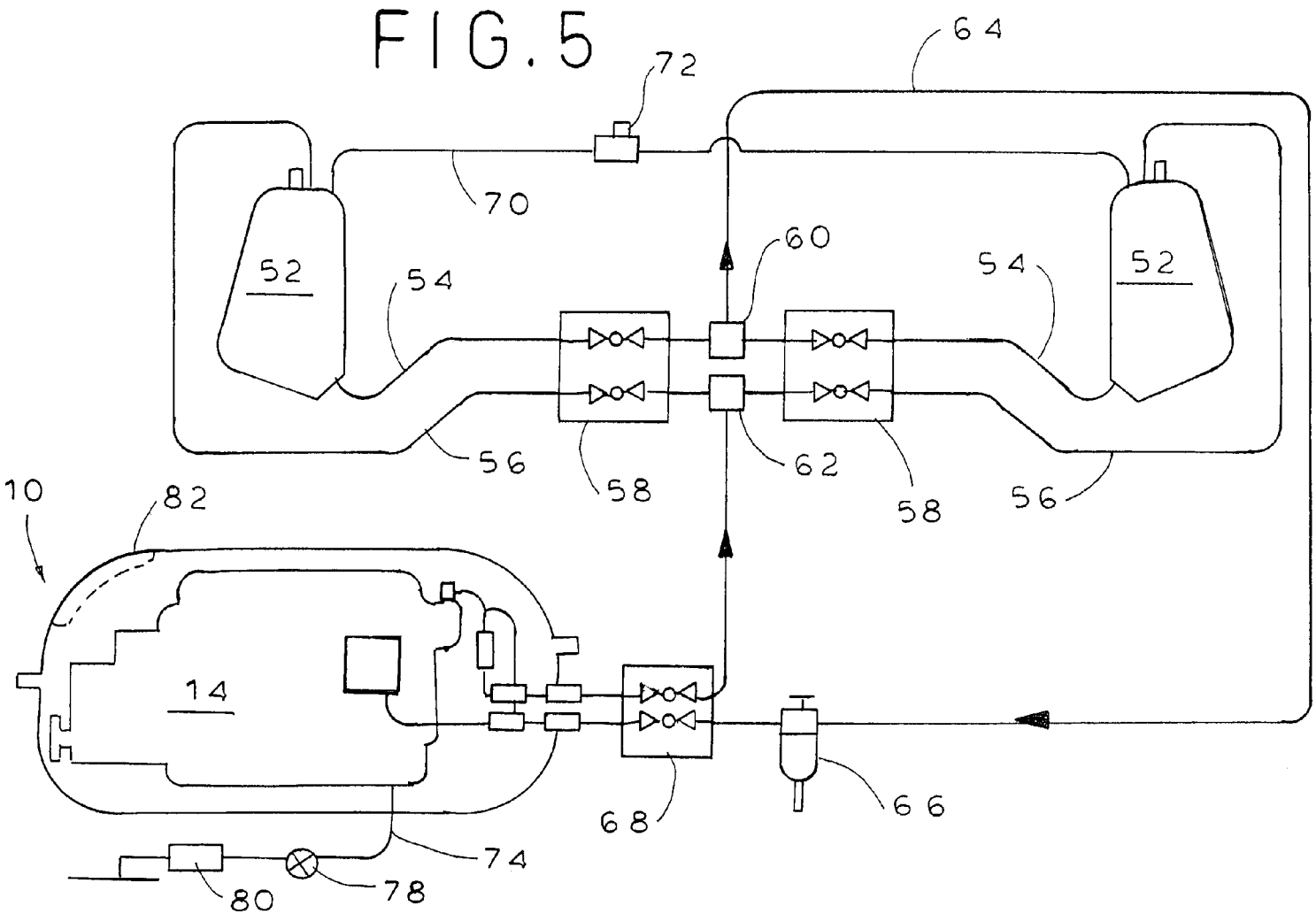
FIG. 5 is a schematic representation of the piping for the fuel system of the engine assembly.

Referring next to FIG. 5, fuel storage for the engine 14 is preferably provided remotely from and exterior to the engine assembly 10. A pair of flexible fuel bladders 52 may be provided, each fuel bladder having a fuel feed line 54 and a fuel return line 56, each of which is valved at 58. The two fuel feed and return lines are combined at T-fittings 60, 62, respectively, and are then led to the engine assembly 10. The main feed line 64 may be provided with a fuel filter and fuel/water separator 66. The fuel feed and return lines also pass through main shut-off valves 68. These valves are provided both for safety shut-off to the engine and also to seal the engine container from the fuel bladders for submerged operation. The secondary valves 58 are used for fuel balancing between the bladders, such as upon refueling, and as safety back-up, and do not have to be closed for submerged operation.

The fuel bladders 52 are also connected by crossover line 70. The crossover line allows fuel transfer between the bladders in the event that one bladder becomes full because of an incorrectly positioned shut-off valve, and also allows, through multiple use fitting 72, the purge of any trapped air in the fuel system, which is particularly critical during submerged operation. The air may be purged by utilizing a hand-operated pump (not shown). Pressure relief valves are also located in the line to provide pressure relief in the event of over-pressurization of the system. Each of the bladders may be of approximately 70-gallon capacity and are positioned on opposite sides of the vessel.

Engine 14 is preferably water-cooled when the system is to be used in a marine environment. A raw water inlet line 74 directs water through the hull bottom 76, through the engine assembly container 12, and into a cooling port on the engine 14. The inlet line is provided with a ball valve 78 and a filter strainer 80. The ball valve may be located near the crew compartment to allow closing down for submerged operation. An exhaust/water mixing manifold 84 of the engine, through which exhaust gases as well as cooling water is discharged, is also ported out through the container through exhaust butterfly valve 86. A water/air separator may be provided in the exhaust system as known in the art.

The Yanmar engine preferred as engine 14 has a 12-volt dc electric system, including an alternator to provide 12-volt output during engine operation. Starter batteries may be located within the container 12, electrical connections between the engine and batteries and other electrical components located in the vessel outside the container being made through a waterproof connector box as known in the art. In a similar manner, the control requirements of a vessel or other operating environment for the engine may include items that require a hydraulic system, normally charged through a hydraulic pump. An appropriate hydraulic pump and associated peripherals, including regulators, accumulators, actuators, and the like, may also be located within the engine container, with hydraulic lines passing through the container by use of appropriate fittings as known in the art. To lower the sound signature of the engine assembly, the interior surface of the container may be coated with an appropriate sound-deadening material 82 such as Quiet-Pro™ sound insulation manufactured by Soundown Company. In addition, the engine mounts 24 may provide vibration and noise isolation. Use of a metalastik-type float mount of Trelleborg Industrial AVS may be employed.

As disclosed, the present invention provided a sealable internal combusion engine "engine room" system capable of installation in a variety of applications that require protection of the engine from water. Modifications, adaptations and variation to the invention as specifically described herein recognized by those skilled in the art are intended to be embraced by the invention.

I claim:

1. A sealable engine containment assembly, comprising a waterproof container; an internal combustion engine within the container; an air inlet port for passage of air from the container exterior into an open interior of the container, the air inlet port having a means of isolating the port from the container exterior; a waterproof coupling for transmission of a drive shaft output to the exterior of the container; and an exhaust port for passage of engine exhaust solely to the container exterior, the exhaust port having a means of isolating the port from the container exterior.

2. The assembly of claim 1 wherein the means of isolating the inlet and exhaust ports are valves, wherein at least one of the valves is remotely controllable.

3. The assembly of claim 1 wherein the exhaust port is coupled to an exhaust manifold of the engine.

4. The assembly of claim 1, wherein the means for isolating the exhaust port is an exhaust port valve located on the exhaust port exterior to the container.

5. The assembly of claim 1 further comprising a water jet propulsor driven by the drive shaft output.

6. A sealable engine containment assembly, comprising a waterproof container; an internal combustion engine within the container; an air inlet port for passage of air from the container exterior into an open interior of the container, the air inlet port having a means of isolating the port from the container exterior; an exhaust port for passage of engine exhaust solely to the container exterior, the exhaust port having a means of isolating the port from the container exterior, and a hydraulic power source coupled to the engine within the container and a waterproof passage for hydraulic lines between the hydraulic power source and the container exterior.

7. A sealable engine containment assembly, comprising a waterproof container; an internal combustion engine within the container; an air inlet port for passage of air from the container exterior, the air inlet port having a means of isolating the port from the container exterior; and an exhaust port for passage of engine exhaust to the container exterior, the exhaust port having a means of isolating the port from the container exterior, the means of isolating the air inlet port comprises a fluid-driven operator and an air inlet cover.

8. The assembly of claim 7, wherein the cover is movable along a straight-line axis parallel to a major axis of the air inlet port.

9. The engine assembly of claim 7, wherein the operator is a hydraulic operator.

10. A sealable engine containment assembly, comprising a waterproof container; an internal combustion engine within the container; an air inlet port for passage of air from the container exterior, the air inlet port having a means of isolating the port from the container exterior; an exhaust port for passage of engine exhaust to the container exterior, the exhaust port having a means of isolating the port from the container exterior, and an air circulation fan located within the container.

11. A sealable engine containment assembly, comprising a waterproof container; an internal combustion engine within the container; an air inlet port for passage of air from the container exterior, the air inlet port having a means of isolating the port from the container exterior; an exhaust port for passage of engine exhaust to the container exterior, the exhaust port having a means of isolating the port from the container exterior, at least one fuel bladder located exterior to the container, and a fuel line from the fuel bladder to the engine passing through the container.

12. The assembly of claim 11 wherein the fuel bladders are two in number and are located on opposite sides of the vessel.

* * * * *